United States Patent [19]

Iwata et al.

[11] Patent Number: 4,952,087

[45] Date of Patent: Aug. 28, 1990

[54] PRINTER FOR USE WITH CONTINUOUS FORM

[75] Inventors: Yasuo Iwata; Michio Koizumi, both of Tokorozawa; Kimihiro Kosugi, Tanashi; Kouzou Abe, Tokyo; Takashi Majima, Tanashi, all of Japan

[73] Assignee: Citizen Watch Co., Ltd., Tokyo, Japan

[21] Appl. No.: 281,056

[22] Filed: Dec. 7, 1988

[30] Foreign Application Priority Data

Dec. 15, 1987 [JP] Japan ..... 62-189514[U]

[51] Int. Cl.[5] ..... B41J 11/26

[52] U.S. Cl. ..... 400/616.1; 226/74

[58] Field of Search ..... 400/618, 616–616 B; 226/74, 75

[56] References Cited

U.S. PATENT DOCUMENTS

| | | | |
|---|---|---|---|
| 2,400,226 | 5/1946 | Enth | 400/616 |
| 4,365,905 | 12/1982 | Jung | 400/616.2 |
| 4,402,623 | 9/1983 | Biche et al. | 400/618 |
| 4,440,516 | 4/1984 | Rosenthal et al. | 400/618 |
| 4,485,950 | 12/1984 | Knelzer | 400/616.1 |
| 4,723,697 | 2/1988 | Tano et al. | 226/74 |
| 4,805,822 | 2/1989 | Milano, Jr. | 226/74 |

FOREIGN PATENT DOCUMENTS

| | | | |
|---|---|---|---|
| 2419849 | 10/1975 | Fed. Rep. of Germany | 400/618 |
| 2814674 | 2/1980 | Fed. Rep. of Germany | 400/616.1 |
| 228411 | 10/1985 | German Democratic Rep. | 400/616.1 |
| 57-42676 | 9/1982 | Japan | 400/616.2 |
| 58-99061 | 7/1983 | Japan | 400/616.2 |
| 172565 | 9/1985 | Japan | 400/616.1 |
| 22967 | 1/1986 | Japan | 400/616.2 |
| 5867 | 1/1987 | Japan | 400/616.1 |

*Primary Examiner*—Eugene H. Eickholt

*Attorney, Agent, or Firm*—Lowe, Price, LeBlanc, Becker & Shur

[57] ABSTRACT

In a printer for use with a continuous form, a tractor drive shaft and a tractor guide shaft are mounted to a tractor frame of a bi-directional form feeder unit in parallel relation to each other. A pair of tractors mounted on both the shafts are movable therealong, but can be fixed to a shaft body of the guide shaft at respective desired positions. Opposite axial ends of the drive shaft are received respectively in a pair of elongated slots whose longitudinal axes extend substantially perpendicularly to a platen. One axial end of the drive shaft is drivingly connected to a drive unit. A pair of support shaft sections extend respectively from opposite axial end faces of the shaft body and are supported by the tractor frame. An axis of the shaft body extends in eccentric relation to an axis common to the support shaft sections. The shaft body is angularly movable about its axis relatively to the tractors. An operating member is mounted to one support shaft section for angularly moving the shaft body about the common axis, thereby moving the tractors toward and away from the platen to adjust tension on the continuous form.

10 Claims, 3 Drawing Sheets

PRINTER FOR USE WITH CONTINUOUS FORM

FIELD OF THE INVENTION

The present invention relates to a printer for use with a continuous form such as a fan folded form or the like and, more particularly, to a mechanism for varying a distance between a platen and a pair of tractors of a bi-directional form feeder unit to adjust tension acting upon the continuous form.

BACKGROUND OF THE PRIOR ART

A printer is known, in which a continuous form such as a fan folded form or the like can be fed bi-directionally by a pair of tractors of a bi-directional form feeder unit. In the known printer, a portion of the continuous form extending between a platen and the tractors tends to slacken due to various factors, including variation in thickness of the continuous form, variation in pitch of sprocket holes formed along opposite side edges of the continuous form, a change in humidity of the environment, and so on.

Various measures have conventionally been taken to prevent the above-mentioned slackening. Japanese Utility Model Application Laid-Open No. 58-99061 discloses an arrangement in which a tension roller is arranged between the platen and the tractors to apply tension to the continuous form, thereby taking up the slack. Further, Japanese Utility Model Publication No. 57-42676 discloses an arrangement in which a pair of support plates are mounted respectively to opposite axial ends of a guide shaft of the form feeder unit, and are moved angularly about the axis of the guide shaft by means of a cam mechanism, to adjust tension acting upon the continuous form. In the former arrangement, the tension roller is not uniformly abutted against the continuous form due to distortion thereof, but is abutted against the continuous form in a one-sided manner, or an amount of deflection of the continuous form varies depending upon the types or kinds of the continuous form. This results in variation in the printing quality. On the other hand, it is required for the latter arrangement to arrange cams and associated mechanisms independently of the tractors, that is, on the outside of the form feeder unit. This results in complication in arrangement of various components around the form feeder unit, making maintenance and inspection troublesome and difficult.

SUMMARY OF THE INVENTION

It is an object of the invention to provide a printer capable of ensuring adjustment of a tension acting upon a continuous form by a simple construction that has a relatively small number of component parts.

According to the invention, there is provided a printer that is for use with a continuous form, which includes a body frame; a platen rotably mounted to the body frame; a bi-directional form feeder unit mounted to the body frame for feeding the continuous form along a predetermined transport path which extends from and to the form feeder unit around the platen; drive means drivingly connected to the form feeder unit for driving the same to feed the continuous form along the predetermined transport path; and means arranged adjacent the platen for printing information onto the continuous form on the platen.

The bi-directional form feeder unit includes a tractor frame formed with a pair of opposed spaced elongated slots having their respective longitudinal axes extending substantially perpendicularly to an axis of the platen.

A tractor drive shaft is rotatably mounted to the tractor frame in parallel relation to the axis of the platen, the tractor drive shaft having opposite axial ends which are respectively received in the pair of elongated slots such that the tractor drive shaft is movable relatively to the tractor frame along the elongated slots. One of the opposite axial ends of the tractor drive shaft is drivingly connected to the drive means for rotatively driving the tractor drive shaft.

A tractor guide shaft is mounted to the tractor frame in parallel relation to the tractor drive shaft, and has a shaft body and a pair of support shaft sections extending respectively from opposite axial end faces of the shaft body, the pair of support shaft sections being supported by the tractor frame for angular movement relative thereto about an axis common to the pair of support shaft sections. The shaft body has an axis extending in eccentric relation to the axis common to the pair of support shaft sections.

A pair of tractors are mounted on the tractor drive shaft and the shaft body of the tractor guide shaft in spaced relation to each other along the tractor drive shaft and the shaft body, the pair of tractors being movable along the tractor drive shaft and the shaft body of the tractor guide shaft, but being capable of being fixed to the shaft body at respective desired locations along the shaft body. The shaft body of the tractor guide shaft is angularly movable about its axis relatively to the pair of tractors.

Operating means are provided with one of the pair of support shaft sections of the tractor guide shaft for angularly moving the shaft body of the tractor guide shaft about the axis common to the pair of support shaft sections, to move the pair of tractors toward and away from the platen while moving the opposite axial ends of the tractor drive shaft along the respective elongated slots, thereby varying a distance between the platen and the pair of tractors to adjust tension acting upon the continuous form extending along the predetermined transport path.

DETAILED DESCRIPTION

Figure 1:
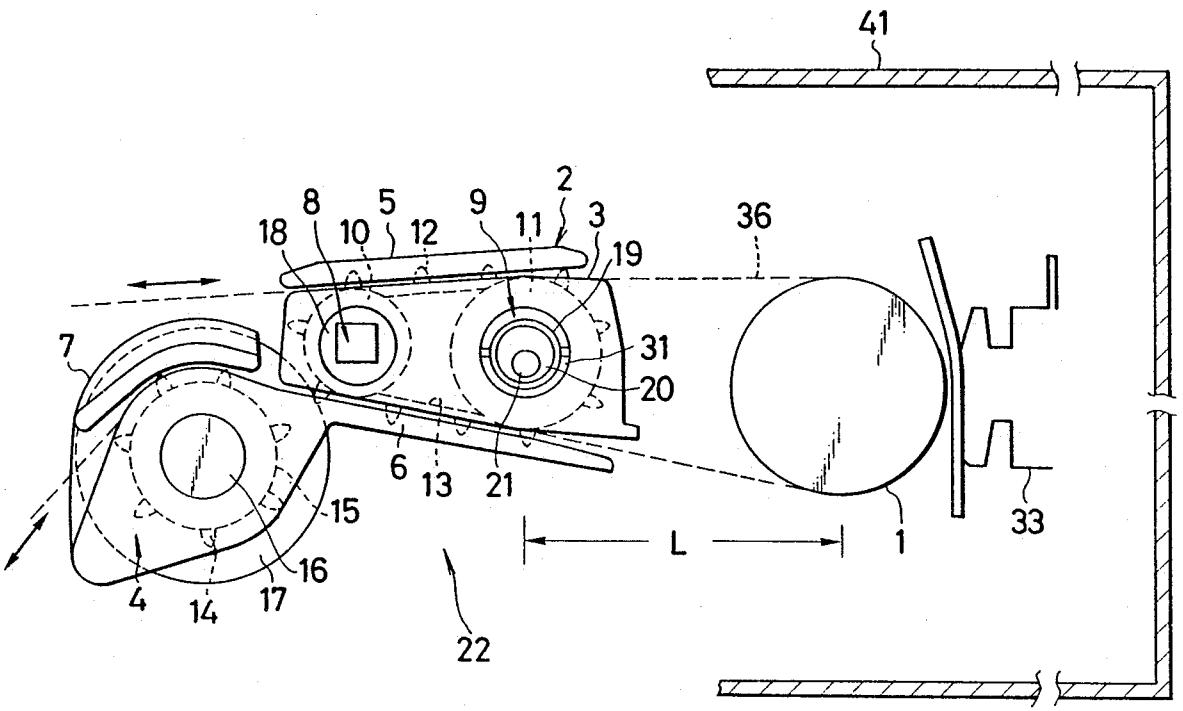
FIG. 1 is a diagrammatic, partially cross-sectional fragmentary view of a printer according to a preferred embodiment of the invention.

Referring to FIG. 1, there is shown a printer suitable for use with a continuous form 36, according to an embodiment of the invention. The printer comprises a body frame 41 to which a platen 1 is mounted rotatably. A bi-directional form feeder unit 22 is fixedly mounted to the body frame 41, for feeding the continuous form 36 along a predetermined transport path which extends from and to the form feeder unit 22 around the platen 1. The form feeder unit 22 includes a pair of tractors 2 and 2 (see FIG. 2). A printing head 33 is arranged adjacent the platen 1 for printing information onto the continuous form 36 on the platen 1.

Each of the pair of tractors 2 is provided with a tractor body 3 and a feeding section 4 arranged rearwardly of a lower surface of the tractor body 3. An upper retainer 5 is associated with an upper surface of the tractor body 3 for pivotal movement relative thereto. Further, a form guide 6 is associated with the lower surface of the tractor body 3. The form guide 6 is formed by a forward extension of a casing of the feeding section 4. The feeding section 4 is provided with a lower retainer 7 movable pivotally.

Figure 2:
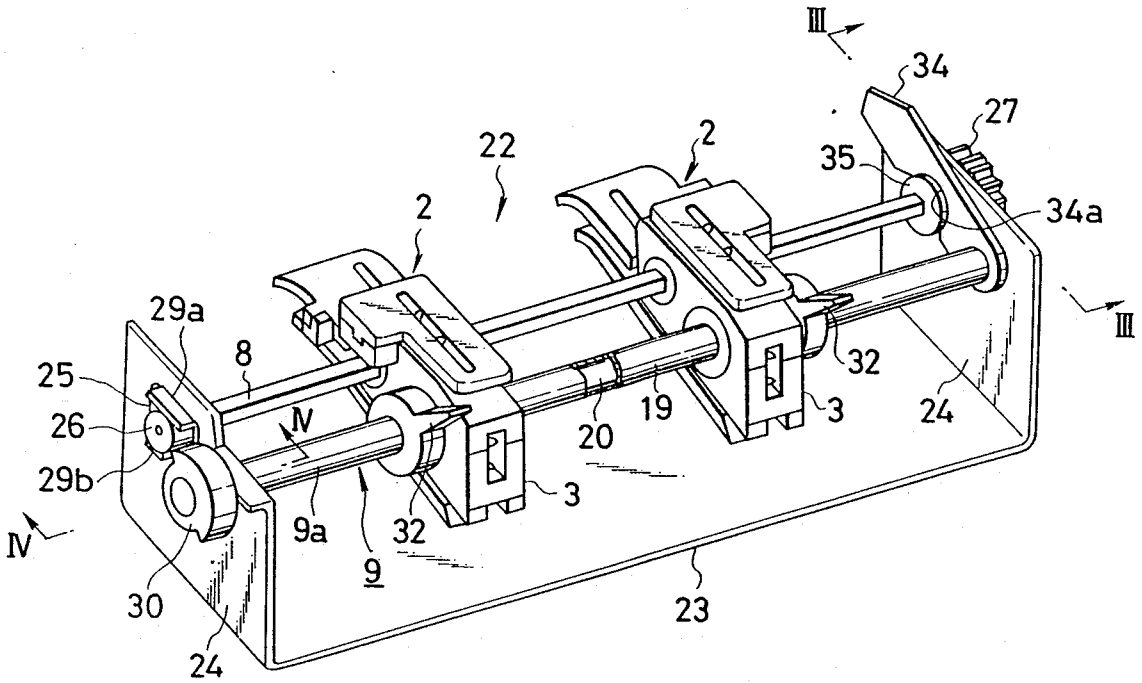
FIG. 2 is a perspective view of a bi-directional form feeder unit illustrated in FIG. 1.

As shown in detail in FIG. 2, the bi-directional form feeder unit 22 comprises a tractor frame 23 which has a pair of opposed, but spaced upstanding walls 24 and 24. A pair of elongated arcuate slots 25 and 25 are formed respectively in the upstanding walls 24 in opposed relation to each other. The elongated slots 25 have their respective arcuate longitudinal axes which extend substantially perpendicularly to an axis of the platen 1 (see FIG. 1). Each elongated slot 25 is formed in such a manner that a part of a corresponding one of the pair of upstanding walls 25 is pushed outwardly by means of a press machine or the like, and a pair of upper and lower halves **29*a* and 29*b* of the pushed-out part are bent perpendicularly to the upstanding wall 25. The pair of bent upper and lower halves 29*a* and 29*b*** serve as guide portions to be described later.

A tractor drive shaft 8 is rotatably mounted to the pair of upstanding walls 24 of the tractor frame 23 in parallel relation to the axis of the platen 1. Specifically, a pair of rollers 26 and 26 (see also FIG. 3) are mounted respectively to opposite axial ends of the tractor drive shaft 8 for rotation therewith. Each roller 26 is in slidable contact with the pair of guide portions **29*a* and 29*b* on a corresponding one of the pair of upstanding walls 24. Thus, the tractor drive shaft 8 is movable relatively to the tractor frame 23 along the pair of elongated slots 25 while each roller 26 is guided by the pair of guide portions 29*a* and 29*b* on the corresponding upstanding wall 24. As shown in FIG. 1, the tractor drive shaft 8 has a rectangular cross-sectional shape, and extends through the tractor body 3 of each tractor 2. A bush bearing 18 having a circular outer periphery and movable along the tractor drive shaft 8 is interposed between the latter and the tractor body 3, whereby the tractor drive shaft 8 is rotatable relatively to the tractor body 3**.

Figure 3:
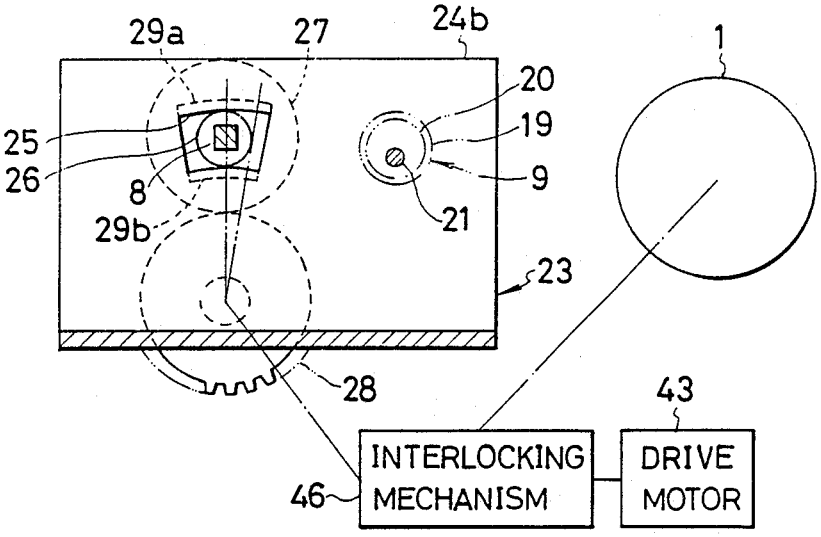
FIG. 3 is a cross-sectional view taken along the line III—III in FIG. 2.

Referring back to FIG. 2, a driven gear 27 is mounted to one of the opposite axial ends of the tractor drive shaft 8 for rotation therewith. As shown in FIG. 3, a drive unit comprises a drive motor 43 and a drive gear 28 drivingly connected to the drive motor 43 through an interlocking mechanism 46. The drive gear 28 is in mesh with the driven gear 27 mounted on the tractor drive shaft 8, to rotatively drive the driven gear 27 and the tractor drive shaft 8. The arcuate longitudinal axis of the elongated slot 25 formed in each of the upstanding walls 24 of the tractor frame 23 has a radius of curvature having a center that is located at a central axis of the drive gear 28. Similarly to the drive gear 28, the platen 1 is drivingly connected to the drive motor 43 through the interlocking mechanism 46, so that the tractor drive shaft 8 and the platen 1 are rotatively driven by the drive motor 43 in synchronism with each other.

Referring back to FIG. 2, a tractor guide shaft 9 extends through the tractor bodies 3 and 3 of the respective tractors 2 and 2, and is mounted to the pair of upstanding walls 24 of the tractor frame 23 in parallel relation to the tractor drive shaft 8. The tractor guide shaft 9 is composed of a shaft body **9*a* and a pair of support shaft sections 21 and 21 which extend respectively from opposite axial end faces of the shaft body 9*a*. The pair of support shaft sections 21 and 21 are supported respectively by the pair of upstanding walls 24 of the tractor frame 23 for angular movement relative thereto about an axis common to the pair of support shaft sections 21 and 21**.

Figure 4:
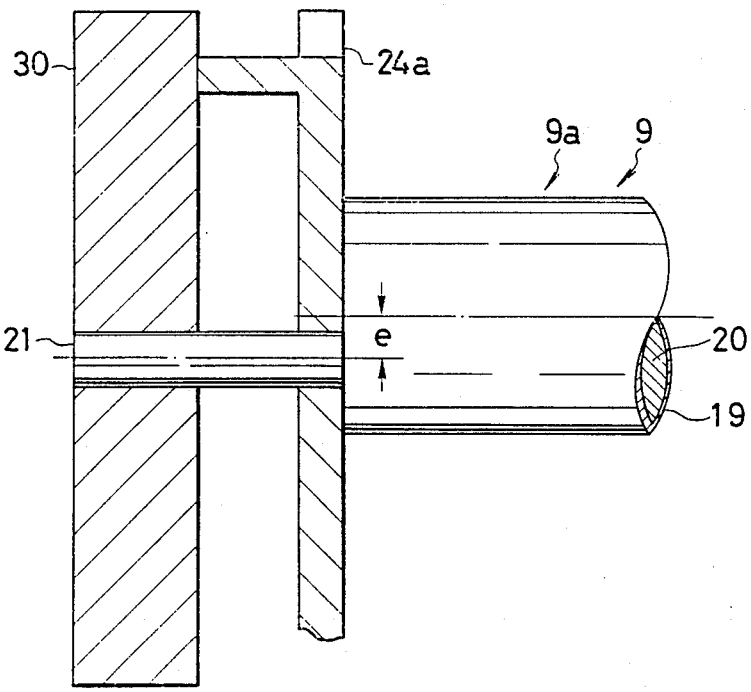
FIG. 4 is an enlarged cross-sectional view taken along the line IV—IV in FIG. 2.

As shown in FIG. 4, the shaft body **9*a* of the tractor guide shaft 9 has an axis which extends in eccentric relation to the axis common to the pair of support shaft sections 21 and 21 with an eccentricity e. Specifically, the shaft body 9*a* of the tractor guide shaft 9 is composed of an outer hollow shaft member 19 consisting of a pipe having a circular cross-sectional shape, and a solid inner shaft member 20 fitted in the outer hollow shaft member 19 in concentric relation thereto. The inner shaft member 20 has a circular cross-sectional shape and is angularly movable relatively to the outer hollow shaft member 19. The opposite axial end faces of the outer hollow shaft member 19 are lightly in contact respectively with inner surfaces of the respective upstanding walls 24 of the tractor frame 23, so that the outer hollow shaft member 19 is prevented from being moved along the inner shaft member 20**.

The pair of support shaft sections 21 and 21 extend respectively from the opposite axial end faces of the inner shaft member 20 in such a manner that the axis of the inner shaft member 20 extends in eccentric relation to the axis common to the pair of support shaft sections 21 and 21. As shown in FIG. 1, the form feeder unit 22 is mounted to the body frame 41 of the printer such that a distance L between the axis of the platen 1 and the axis common to the pair of support shaft sections 21 and 21 is maintained constant.

As shown in FIG. 2, the aforementioned pair of tractors 2 and 2 are mounted on the tractor shaft 8 and the shaft boy **9*a* of the tractor guide shaft 9 in spaced relation to each other along the tractor drive shaft 8 and the shaft body 9*a*. The pair of tractors 2 and 2 are movable along the tractor drive shaft 8 and the shaft body 9*a* of the tractor guide shaft 9. The tractor body 3 of each tractor 2 is lockable at any desired location to the outer hollow shaft member 19 of the tractor guide shaft 9 through a chuck 31 composed of a pair of semi-circular elements. Specifically, a lock lever 32 is mounted to the tractor body 3. When the lock lever 32 is moved angularly in one direction to reduce the diameter of the chuck 31, the chuck 31 is tightened about the outer hollow shaft member 19 so that the tractor 2 can be fixed to the outer hollow shaft member 19. On the other hand, when the lock lever 32 is moved angularly in the opposite direction to enlarge the diameter of the chuck 31, the tractor 2 is permitted to be moved along the tractor drive shaft 8 and the shaft body 9*a* of the tractor guide shaft 9. In this manner, the pair of tractors 2 and 2 are capable of being fixed to the shaft body 9*a* of the tractor guide shaft 9 at respective desired locations along the shaft body 9*a***.

As shown in FIG. 1, each of the pair of tractors 2 and 2 has a drive sprocket 10 and an idle sprocket 11 which are arranged within the tractor body 3. The drive sprocket 10 is mounted on the tractor drive shaft 8 for rotation therewith. On the other hand, the idle sprocket 11 is mounted on the shaft body **9*a* of the tractor guide shaft 9 for rotation about the axis of the shaft body 9*a*. A toothed endless belt 13 extends between and passes around the drive and idle sprockets 10 and 11. The toothed endless belt 13 is formed on its outer peripheral surface with a plurality of projections 12 which are spaced equidistantly from each other along a running direction of the endless belt 13. The projections 12 on the toothed endless belt 13 of each of the pair of tractors 2 and 2 are engageable with sprocket holes formed along a corresponding one of the opposite side edges of the continuous form 36. In the feeding section 4 of each tractor 2, a feeding sprocket 15 provided on its outer periphery with a plurality of projections 14 is mounted on a shaft 16 for rotation therewith. The shaft 16 is drivingly connected to the tractor drive shaft 8 through an interlocking mechanism having a gear 17**.

As shown in FIG. 2, an operating member 30 is fixedly mounted to one of the pair of support shaft sections 21 and 21 at a location on the outside of the upstanding wall 24 of the tractor frame 23 by which the one support shaft section 21 is supported. The operating member 30 is so designed as to move the shaft body **9*a* of the tractor guide shaft 9 angularly about the axis common to the pair of support shaft sections 21 and 21, and to enable the shaft body 9*a* to be fixed at a predetermined angular position. The arrangement is such that when the shaft body 9*a* is moved by the operating body 30 angularly about the axis common to the pair of support shaft sections 21 and 21, the angular movement of the shaft body 9*a* causes the pair of tractors 2 and 2 to be moved toward and away from the platen 1 while moving the rollers 26 mounted respectively to the opposite axial ends of the tractor drive shaft 8 along the respective elongated slots 25, thereby varying the distance between the platen 1 and the pair of tractors 2 and 2 to adjust tension acting upon the continuous form 36** extending along the predetermined transport path.

A spacer lever 34 has one end thereof which is mounted on the shaft body **9*a* of the tractor guide shaft 9 for pivotal movement about the axis of the shaft body 9*a*. A roller 35 is mounted on the tractor drive shaft 8 for rotation therewith. The spacer lever 34 is formed with a recess 34*a* in which the roller 35 is fitted slidably. In this manner, the spacer lever 34 cooperates with the roller 35 to keep constant the distance between the axis of the tractor drive shaft 8 and the axis of the shaft body 9*a* of the tractor guide shaft 9**.

The operation of the printer constructed as above will now be described.

In FIG. 1, the lower retainer 7 and the upper retainer 5 of each of the pair of tractors 2 are moved pivotally to their respective open positions, and the sprocket holes in a corresponding one of the opposite side edges of the leading edge portion of the continuous form 36 are engaged with the projections 14 on the feeding sprocket 15 of the feeding section 4 of the tractor 2. The lower retainer 7 is then returned to its closed position shown in FIG. 1. Subsequently, the drive motor 43 shown in FIG. 3 is driven to rotate the tractor drive shaft 8, thereby feeding the continuous form 36 automatically into the nip between the lower surface of the tractor body 3 and the form guide 6. The projections 12 on the lower run of the toothed endless belt 13 are engaged with the sprocket holes in the fed continuous form 36, to feed the same toward the platen 1. Subsequently, the sprocket holes in the leading edge portion of the continuous form 36 having passed around the platen 1 are engaged with the projections 12 on the upper run of the toothed endless belt 13, and then the upper retainer 5 is returned to its closed position shown in FIG. 1. In this manner, setting of the continuous form 36 with respect to the pair of tractors 2 and 2 is completed as shown in FIG. 1. By switching the rotational direction of the tractor drive shaft 8 with the continuous form 36 set as shown in FIG. 1, the continuous form 36 can be transported relatively to the platen 1 selectively in either direction as indicated by an arrow in FIG. 1.

If slack occurs in the upper and lower portions of the continuous form 36 extending between the platen 1 and the pair of tractors 2 and 2 when the continuous form 36 is set, or during the printing operation, the operating member 30 is manipulated to move the shaft body **9*a* of the tractor guide shaft 9 angularly about the axis common to the pair of support shaft sections 21 and 21. The angular movement of the shaft body 9*a* eccentric to the axis common to the pair of support shaft sections 21 and 21 causes the pair of tractors 2 and 2 to be moved together with the tractor drive shaft 8 toward and away from the platen 1, thereby varying the distance between the tractors 2 and the platen 1. Thus, tension acting upon the upper and lower portions of the continuous form 36 extending between the tractors 2 and the platen 1** is adjusted.

When the operating member 30 is manipulated to angularly move the tractor guide shaft 9, the tractor drive shaft 8 is moved along the pair of elongated slots 25 formed in the tractor frame 23 of the form feeder unit 22, toward and away from the platen 1. However, since the elongated slots 25 are formed arcuately as mentioned previously, the meshing relation between the driven gear 27 and the drive gear 28 is maintained unchanged. Accordingly, the driving force from the drive motor 43 is smoothly transmitted to the tractors 2 for feeding the continuous form 36. At this time, the spacer lever 34 keeps constant the distance between the tractor drive shaft 8 and the tractor guide shaft 9, so as to effect smooth rotation of these shafts and smooth movement of the tractors 2, 2.

Moreover, since the tensions acting respectively upon the portions of the continuous form 36 upstream and downstream of the platen 1 with reference to the transport direction are adjusted simultaneously, the amount of movement of the tractors 2 toward and away from the platen 1 is slight.

The shaft body **9*a* of the tractor guide shaft 9 is of double structure composed of the outer hollow shaft member 19 and the inner shaft member 20 fitted therein. Accordingly, when the inner shaft member 20 is moved angularly by the operating member 30, the tractors 2 are not directly moved angularly because of interposition of the outer hollow shaft member 19. By this reason, even if the tractors 2 are maintained fixed to the shaft body 9*a* of the tractor guide shaft 9 or to the outer hollow shaft member 19 thereof by the chuck 31, it is possible to move the tractors 2 toward and away from the platen 1**.

It is essential for functioning of the tractor guide shaft 9 that the shaft body **9*a* is angularly movable relatively to the tractors 2 and extends in eccentric relation to the axis common to the pair of support shaft sections 21 and 21. It is to be understood, however, that the shaft body 9*a* of the tractor guide shaft 9 is not limited to the double structure in the illustrated embodiment. That is, the outer hollow shaft member 19 of the illustrated embodiment may be dispensed with. In this case, the chucks 31 are loosened by the respective lock levers 32 and, thereafter, the positions of the pair of tractors 2 and 2 relative to the platen 1 are adjusted by the operating member 30**.

In the illustrated embodiment, the inner shaft member 20 fitted in the outer hollow shaft member 19 has been described as being circular in cross-section. However, the inner shaft member 20 may have a rectangular cross-sectional shape, if angular movement of the inner shaft member 20 in an eccentric manner about the axis common to the pair of support shaft sections 21 and 21 can be transmitted to the tractors 2 through the outer hollow shaft member 19.

Furthermore, the driven gear 27 mounted to one end of the tractor drive shaft 8 and the drive shaft 28 of the drive unit may be replaced by a pair of pulleys connected to each other through a timing belt.

As described above, the arrangement of the printer according to the invention is such that the tractor guide shaft 9 per se is provided with the function of an eccentric cam for moving the tractors 2 toward and away from the platen 1. With such an arrangement, the form feeder unit 22 can be simplified in construction, and the number of its component parts reduced, thereby facilitating both maintenance and inspection. Furthermore, since the pair of tractors 2 and 2 with which the continuous form 36 is engaged are displaced relatively to the platen 1 directly by the tractor guide shaft 9 on which the tractors 2 are mounted, adjustment of the tension acting upon the continuous form 36 is ensured.

Still other objects and advantages of the present invention will become readily apparent to those skilled in this art from the preceding detailed description, wherein only the preferred embodiments of the invention are illustrated and described, as aforementioned, simply by way of presenting the best modes contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive, the invention being defined solely by the claims appended hereto.

What is claimed is:

1. A printer for use with a continuous form, comprising:

a body frame;

a platen rotatably mounted to said body frame;

a bi-directional form feeder unit mounted to said body frame for feeding said continuous form along a predetermined transport path which extends from and to said form feeder unit around said platen;

drive means drivingly connected to said form feeder unit for driving the same to feed said continuous form along said predetermined transport path; and means arranged adjacent said platen for printing information onto said continuous form on said platen, wherein said bi-directional form feeder unit comprises a tractor frame formed with a pair of opposed and spaced elongated slots having their respective longitudinal axes extending substantially perpendicularly to an axis of said platen, a tractor drive shaft rotatably mounted to said tractor frame in parallel relation to the axis of said platen, said tractor drive shaft having opposite axial ends thereof which are received respectively in said pair of elongated slots in such a manner that said tractor drive shaft is movable relatively to said tractor frame along said elongated slots, wherein one of said opposite axial ends of said tractor drive shaft is drivingly connected to said drive means for rotatively driving said tractor drive shaft, a tractor guide shaft mounted to said tractor frame in parallel relation to said tractor drive shaft, said tractor guide shaft having a shaft body and a pair of support shaft sections extending respectively from opposite axial end faces of said shaft body, said pair of support shaft sections being supported by said tractor frame for angular movement relative thereto about an axis common to said pair of support shaft sections, said shaft body having an axis extending in eccentric relation to said axis common to said pair of support shaft sections, a pair of tractors mounted on said tractor drive shaft and said shaft body of said tractor guide shaft in spaced relation to each other along said tractor drive shaft and said shaft body, said pair of tractors being movable along said tractor drive shaft and said shaft body of said tractor guide shaft and being capable of being fixed to said shaft body at respective desired locations along said shaft body, said shaft body of said tractor guide shaft being angularly movable about its axis relatively to said pair of tractors, and operating means associated with one of said pair of support shaft sections of said tractor guide shaft for angularly moving said shaft body of said tractor guide shaft about said axis common to said pair of support shaft sections, to move said pair of tractors toward and away from said platen while moving said opposite axial ends of said tractor drive shaft along the respective elongated slots, thereby varying a distance between said platen and said pair of tractors to thereby adjust a tension acting upon said continuous form extending along said predetermined transport path, said bi-directional form feeder unit further including driven means mounted on one of said opposite axial ends of said tractor drive shaft for rotation therewith, said driven means being drivingly connected to said drive means for rotatively driving said tractor drive shaft, and said driven means comprises a driven gear, wherein said drive means includes a drive gear in mesh with said driven gear, and wherein said longitudinal axes of the respective elongated slots extend arcuately in such a manner that the arcuate longitudinal axes have their respective radii of curvature whose respective centers are located at a central axis of said drive gear.

2. A printer according to claim 1, wherein:

said drive means includes a drive motor and an interlocking mechanism drivingly connected to said drive motor, and wherein said drive gear and said platen are drivingly connected to said drive motor through said interlocking mechanism so that said tractor drive shaft and said platen are rotatively driven by said drive motor in synchronism with each other.

3. A printer according to claim 1, wherein:

said shaft body of said tractor guide shaft is composed of an outer hollow shaft member and an inner shaft member fitted in said outer hollow shaft member in concentric relation thereto, said pair of tractors being mounted on said outer hollow shaft member for movement therealong, and said pair of support shaft sections extending respectively from opposite axial end faces of said inner shaft member in such a manner that an axis of said inner shaft member extends in eccentric relation to said axis common to said pair of support shaft sections.

4. A printer according to claim 1, wherein:

each of said pair of tractors comprises a drive sprocket mounted on said tractor drive shaft for rotation therewith, an idle sprocket mounted on said shaft body of said tractor guide shaft for rotation about the axis of said shaft body, and an endless belt extending between and passing around said drive and idle sprockets.

5. A printer according to claim 4, wherein:

the endless belt of each of said pair of tractors has an outer peripheral surface provided with a plurality of projections arranged along a running direction of the endless belt in equidistantly spaced relation to each other, said projections on the endless belt of each of said tractors being engageable with sprocket holes formed along a corresponding one of opposite side edges of said continuous form.

6. A printer according to claim 4, wherein:

said tractor drive shaft has a rectangular cross-sectional shape.

7. A printer according to claim 1, wherein:

said bi-directional form feeder unit further includes a pair of locking means associated respectively with said pair of tractors for locking the same onto said shaft body of said tractor guide shaft, thereby fixing said tractors to said shaft body at their respective desired locations along said shaft body.

8. A printer according to claim 1, wherein:

said bi-directional form feeder unit further includes a pair of rollers mounted respectively on the opposite axial ends of said tractor drive shaft for rotation therewith, said pair of rollers being slidable respectively along said pair of elongated slots.

9. A printer according to claim 1, wherein:

said bi-directional form feeder unit further includes spacer means arranged between said tractor drive shaft and said shaft body of said tractor guide shaft for maintaining constant a distance between the axis of said tractor drive shaft and the axis of said shaft body.

10. A printer according to claim 9, wherein:

said spacer means comprises a spacer lever having one end thereof mounted on said shaft body of said tractor guide shaft for pivotal movement about the axis of said shaft body, and a roller mounted on said tractor drive shaft for rotation therewith, said spacer lever being formed with a recess in which said roller is fitted slidably.

* * * * *